US005927777A

United States Patent [19]

Kuo et al.

[11] Patent Number: 5,927,777

[45] Date of Patent: Jul. 27, 1999

[54] LOCK SET WITH IMPROVED SPINDLE CONSTRUCTION

[75] Inventors: Ching-Chuan Kuo, Chia-Yi Hsien; Ming-Shyang Chiou, Chia-Yi; Cheng-Wen Lai; Rong-Faa Wu, both of Chia-Yi Hsien; Po-Yang Chen, Chia-Yi, all of Taiwan

[73] Assignee: Tong-Lung Metal Industry Co., Ltd., Chia-Yi, Taiwan

[21] Appl. No.: 09/081,531

[22] Filed: May 19, 1998

Related U.S. Application Data

[60] Division of application No. 08/604,765, Feb. 22, 1996, Pat. No. 5,788,296, which is a continuation-in-part of application No. 08/490,910, Jun. 16, 1995, abandoned.

[51] Int. Cl.[6] ..... E05B 3/00

[52] U.S. Cl. ..... 292/358; 70/224

[58] Field of Search ..... 292/358, 359, 292/169.23, 336.3, DIG. 27; 70/222–224, 422, 472, 218

[56] References Cited

U.S. PATENT DOCUMENTS

| | | | |
|---|---|---|---|
| 2,627,436 | 2/1953 | Cerf . | |
| 4,333,324 | 6/1982 | Dietrich | 70/107 |
| 5,074,607 | 12/1991 | Lin | 292/359 |
| 5,284,372 | 2/1994 | Lin | 292/336.3 |
| 5,301,526 | 4/1994 | Fann | 70/224 |
| 5,372,025 | 12/1994 | Lin | 70/472 |
| 5,482,335 | 1/1996 | Zuckerman | 292/359 |
| 5,666,833 | 9/1997 | Gao | 70/224 |

*Primary Examiner*—Steven Meyers
*Assistant Examiner*—Gary Estremsky
*Attorney, Agent, or Firm*—Ladas & Parry

[57] ABSTRACT

A lock set for a door has a cylindrical spindle integrally coupled with a knob and containing a slide plate which can be actuated to lock and unlock the cylindrical spindle against rotation. The cylindrical wall of the spindle is provided with two diametrically opposing grooves which extend axially from one end thereof to a predetermined depth and which are opened at the one end so as to facilitate installation of the slide plate in the spindle. The slide plate has two opposing lugs for insertion into the grooves.

5 Claims, 11 Drawing Sheets

LOCK SET WITH IMPROVED SPINDLE CONSTRUCTION

This application is a division of U.S. Ser. No. 08/604,765 now U.S. Pat. No. 5,788,296 filed Feb. 22, 1996 which is a continuation-in-part application of U.S. Ser. No. 08/490,910 filed Jun. 16, 1995 now abandoned, which are hereby incorporated herein by reference.

BACKGROUND OF THE INVENTION

1. Field of the Invention

This invention relates to a lock set and particularly to a lock set which comprises a hand operable unit such as knob integrally coupled with a tubular-shaped spindle to operate a deadbolt of a door lock.

2. Description of the Related Art

It is known to provide a lock set which comprises an outer knob integrally coupled with an outer spindle and a key operable lock, and an inner knob integrally coupled with an inner spindle and incorporating a turning rod member. A deadbolt of a door can be actuated via rotation of the inner and outer spindles and the rotation of the outer spindle can be lock and unlocked by means of a slide plate which can be actuated by the turning rod member. Typically, the outer spindle of such a lock set has a tubular wall with an opening for the slide plate to enter into the inside of the outer spindle, and the turning rod member which has a portion axially extending into the outer spindle passes through a slot of the slide plate. In common practice, the access opening for the slide plate is provided circumferentially in the tubular wall so as to insert the slide plate in a radial direction from one side of the wall. An example of such a spindle construction is disclosed in U.S. Pat. No. 5, 301,526 which is owned by the Applicant of the current application.

Another example of such a lock set is disclosed in U.S. Pat. No. 2,989,332. The lock set as disclosed has a slide plate with two opposite lugs. After the slide plate is inserted into the tubular wall of an outer spindle along a radial direction, one of the lugs is loaded with a spring and is arranged to bear against one side of the tubular wall. Generally, difficulties occur during the installation of the slide plate, the turning rod and other relative components into the outer spindle owing to the fact that a compression spring is loaded between shoulders of the turning rod and the slide plate and that the slide plate is inserted in a radial direction which is transverse to the direction along which the turning rod is inserted.

SUMMARY OF THE INVENTION

An object of the present invention is to provide a lock set by which the difficulties existing in the conventional lock set can be eliminated and by which the slide plate and other components can be installed in an outer spindle in a more convenient manner.

According to one aspect of the present invention, a lock set for a door comprises:

an outer hand operable unit;

an outer spindle integrally coupled with the outer hand operable unit for simultaneous rotation therewith and having a cylindrical wall;

at least one slide plate mounted in the outer spindle and slidable diametrically relative to the outer spindle and having two lugs one of which serves as a locking element for movement between a locking and unlocking position so as to lock and unlock rotary movement of the outer spindle, the slide plate further having a middle portion between the lugs and a hole in the middle portion;

an inner hand operable unit;

an inner spindle integrally coupled with the inner hand operable unit for simultaneous rotation therewith;

a middle spindle disposed between inner and outer spindles for transmitting movement therebetween;

a turning rod passing through the middle spindle and having two ends respectively extending into outer and inner spindles, the turning rod further extending through the hole of the slide plate; and improvements wherein the cylindrical wall of the outer spindle has two diametrically opposing grooves which extend axially from one end of the cylindrical wall for receiving the lugs and each of which has a groove bottom at a predetermined depth, and the grooves being open at the end of the outer spindle to facilitate insertion of the lugs.

The present exemplary preferred embodiments will be described in detail with reference to the accompanying drawings, in which:

DETAILED DESCRIPTION OF THE PREFERRED EMBODIMENTS

Figure 1:
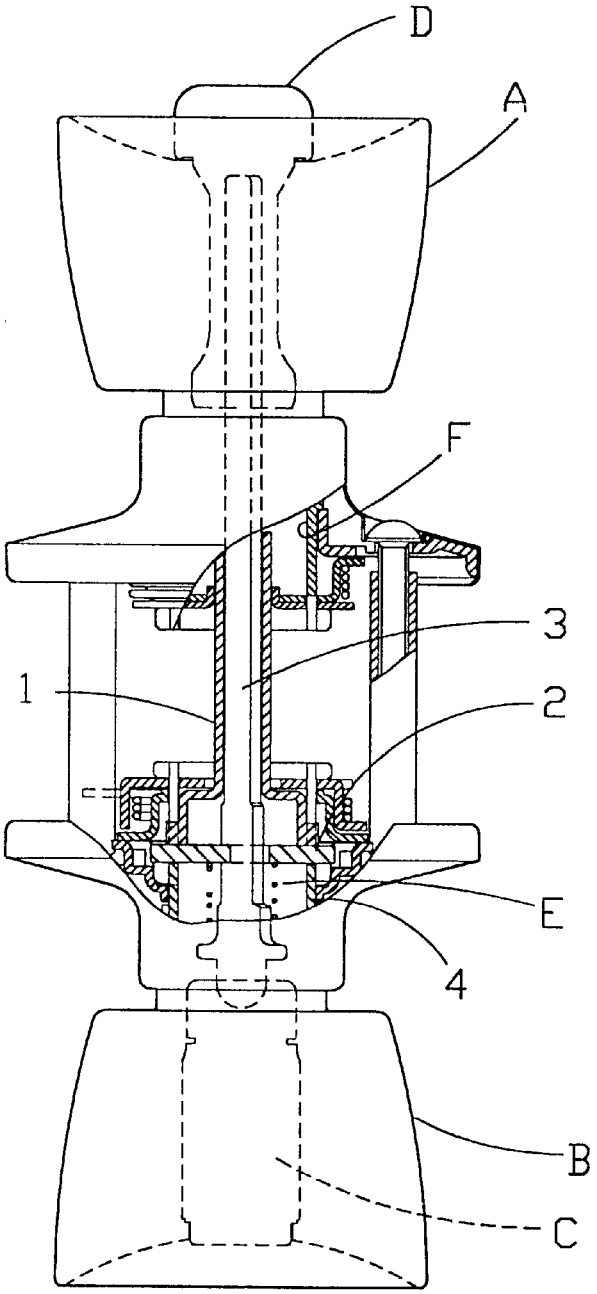
FIG. 1 shows a lock set incorporating the present invention.

Referring to FIG. 1, a lock set is shown, having inner and outer knobs (A) and (B). An outer spindle 4 is integrally coupled with a key operable lock (C) of the outer knob (B) for simultaneous rotation therewith. A turning rod 3 is mounted in the inner knob (A) and has a turning piece (D) to be manually operated from the inside of a door. The turning rod 3 is turnable relative to the inner knob (A). A middle spindle 1 has a hollow body 11 with a bore 14 of square cross-section and is provided between the inner and outer spindles (F) and (4) for connection with a deadbolt (not shown) and for transmitting rotational movement between the inner spindle (F) or inner knob (A) and the outer spindle 4. The turning rod 3 has two ends 31 and 32 respectively extending into inner and outer spindles (F) and (4) and passes through middle spindle 1 and engage a slide plate 2 which is slidably mounted to the outer spindle 4 for movement between locking and unlocking positions. A spring (E) is loaded between shoulder members 33 of the turning rod 3 and the slide plate 2.

Figure 2:
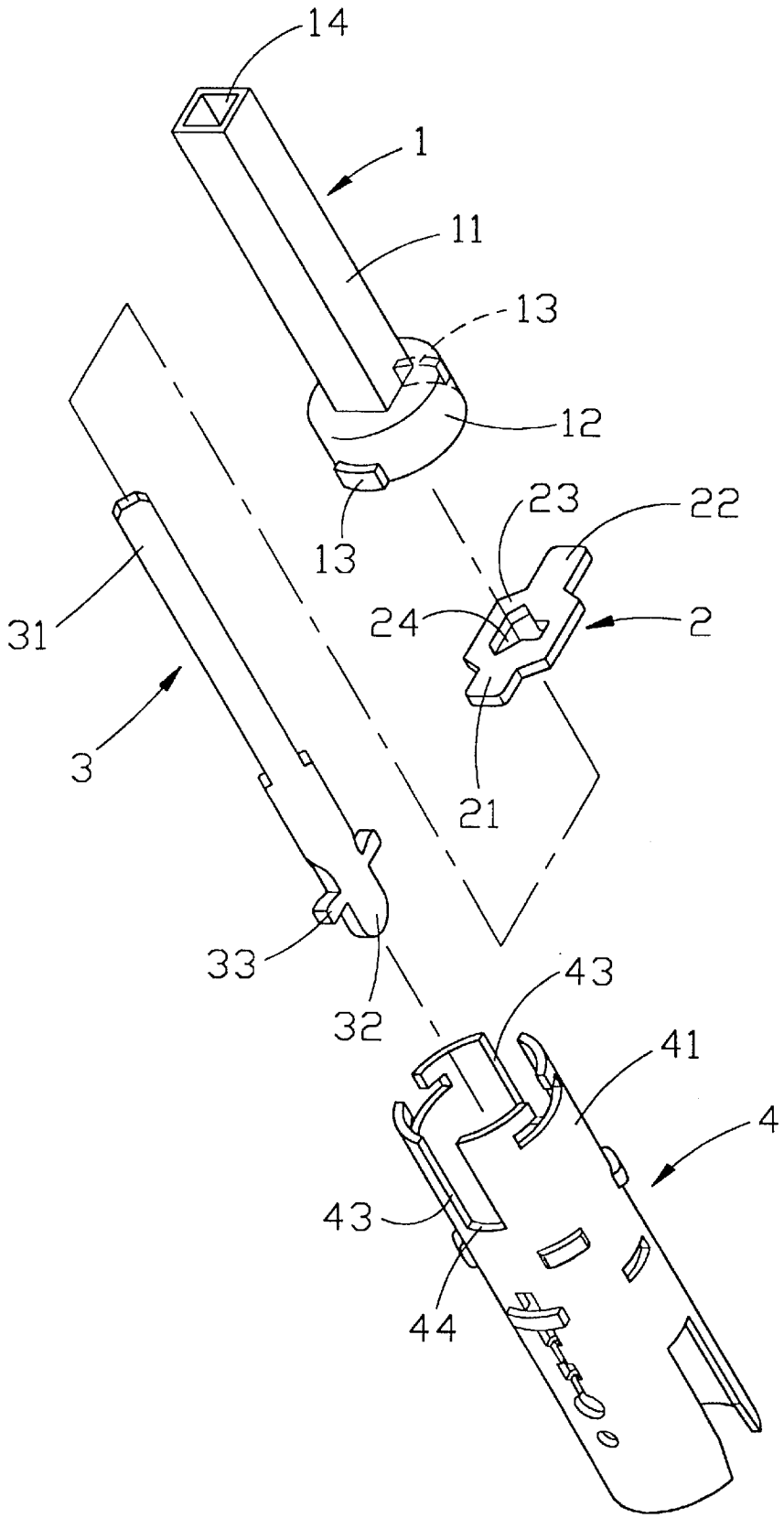
FIG. 2 is an exploded view of a first embodiment of the present invention.

FIG. 2 illustrates in detail the construction of the middle spindle 1, slide plate 2, turning rod 3 and outer spindle 4. The slide plate 2 has first and second lugs 21 and 22 and a middle part 23 which has a hole 24 for inserting the turning rod 3. An important feature of the invention resides in the improved construction of the outer spindle 4 which comprises two diametrically opposing grooves 43 extending axially in the cylindrical wall thereof. Each groove 43 is opened at one end 41 of the outer spindle 4 and extends to a predetermined depth so that the slide plate 2 can be easily put into the outer spindle 4 by inserting the lugs 21 and 22 of the slide plate into the grooves 43 from the end 41 to the groove bottoms 44.

Figure 3:
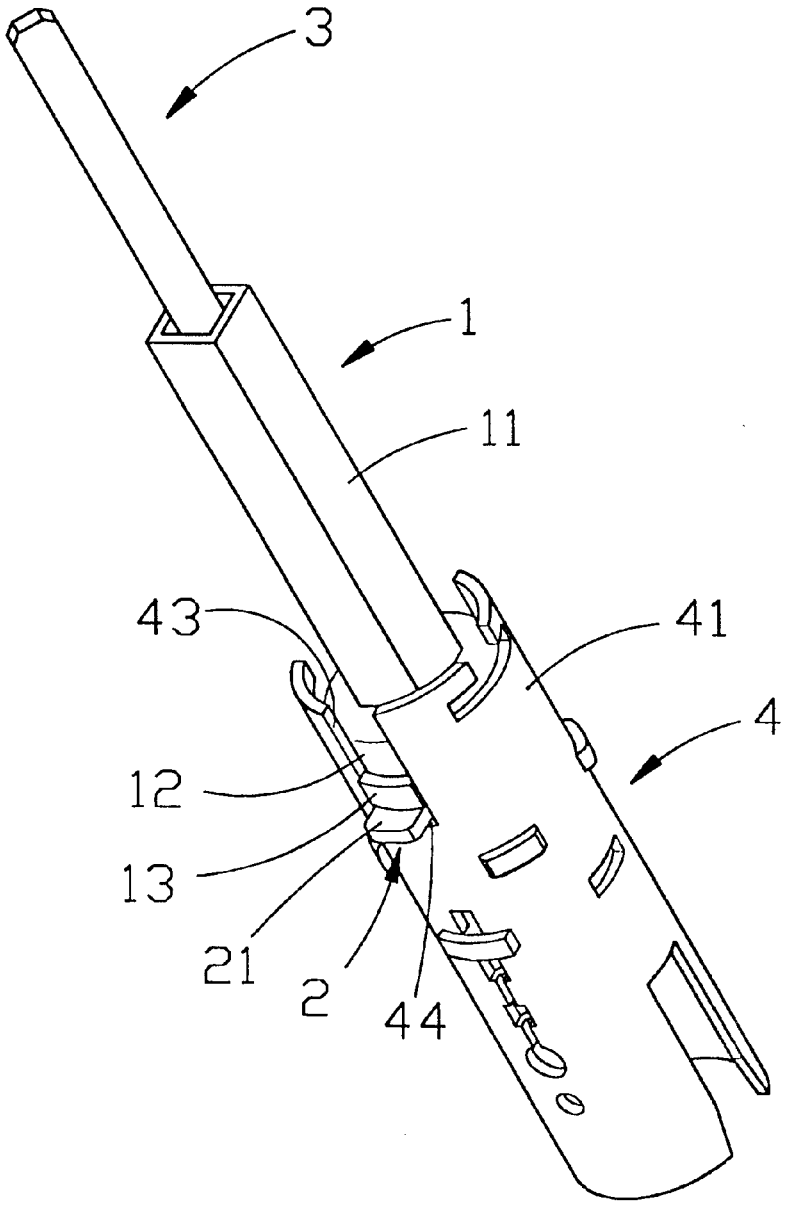
FIG. 3 is a perspective view of the first embodiment.

The middle spindle 1 is provided with an enlarged end 12 which has protrusions 13 radially and outwardly projecting at the locations corresponding to the grooves 43 of the outer spindle 4 so that, when the enlarged end 12 of the middle spindle 1 is placed into the outer spindle 4, the protrusions 13 engage the grooves 43. The turning rod 3 is inserted axially from the outer spindle 4 toward the inner spindle (F). Since the turning rod 3 and the slide plate 2 are both inserted into the outer spindle 4 in axial directions, they can be easily placed in their proper positions, with the compression spring (E) being provided therebetween. The assembly of the outer spindle 4, turning rod 3, slide plate 2 and middle spindle 1 are shown in FIG. 3. It can be seen that each lug 21 or 22 of the slide plate is disposed between the respective groove bottom 44 of the outer spindle 4 and the respective protrusion 13 of the middle spindle 1.

When the turning piece (D) is turned, the turning rod 3 will move the slide plate 2 diametrically in a conventional manner so that the lug 22 can move between its locking position in which it protrudes outward, and an unlocking position in which it is retracted. The arrangement for locking and unlocking the slide plate 2 is conventional and the details thereof will not be described herein. The middle spindle 1 which engages the outer spindle 4 via protrusions 13 and which is rotatable together with the inner knob (A) functions to rotate the outer spindle 4 after the slide plate 2 retracts into the outer spindle 4 or the outer spindle 4 is unlocked.

Figure 4:
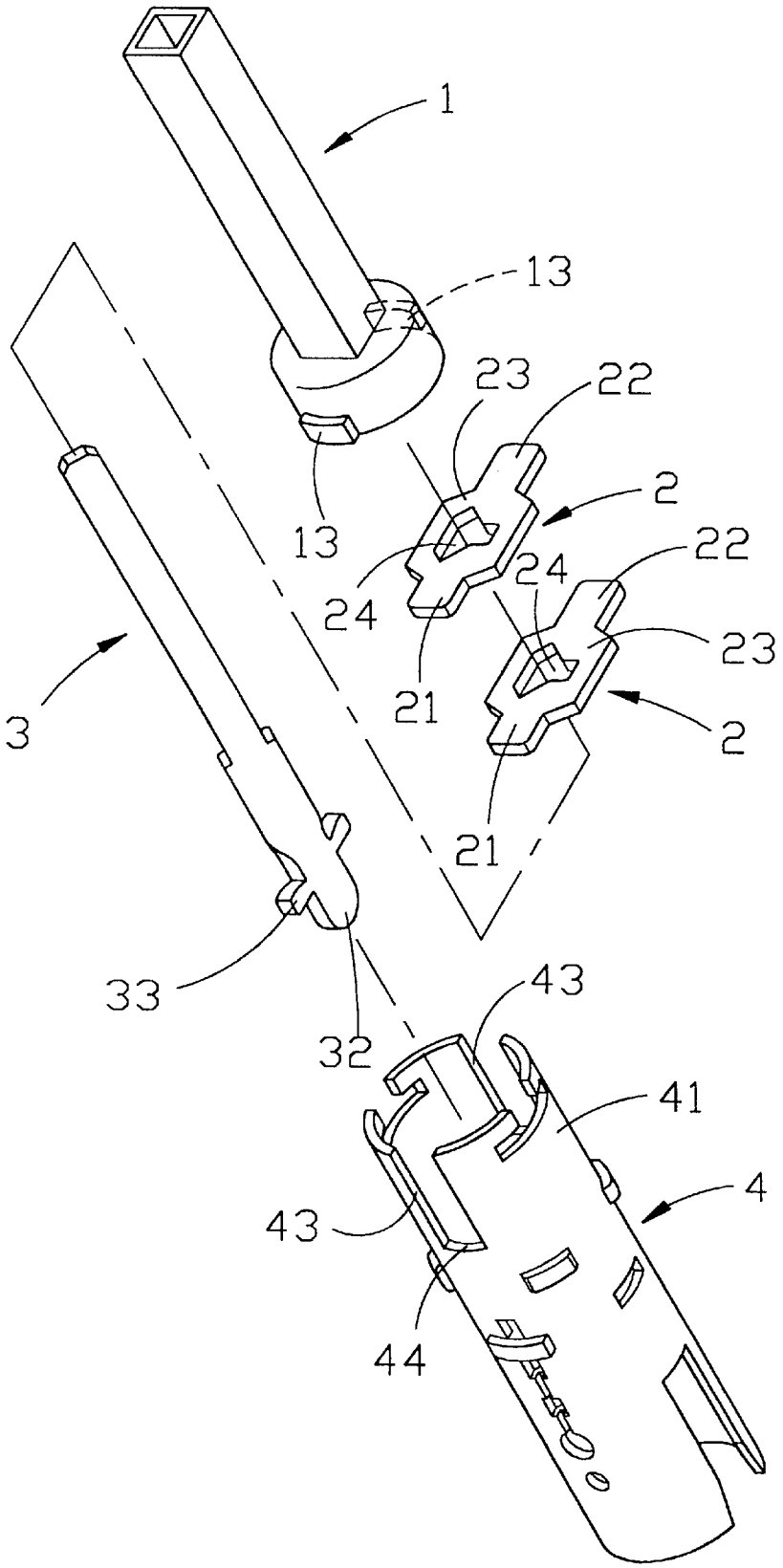
FIG. 4 shows a second embodiment of the present invention.
Figure 5:
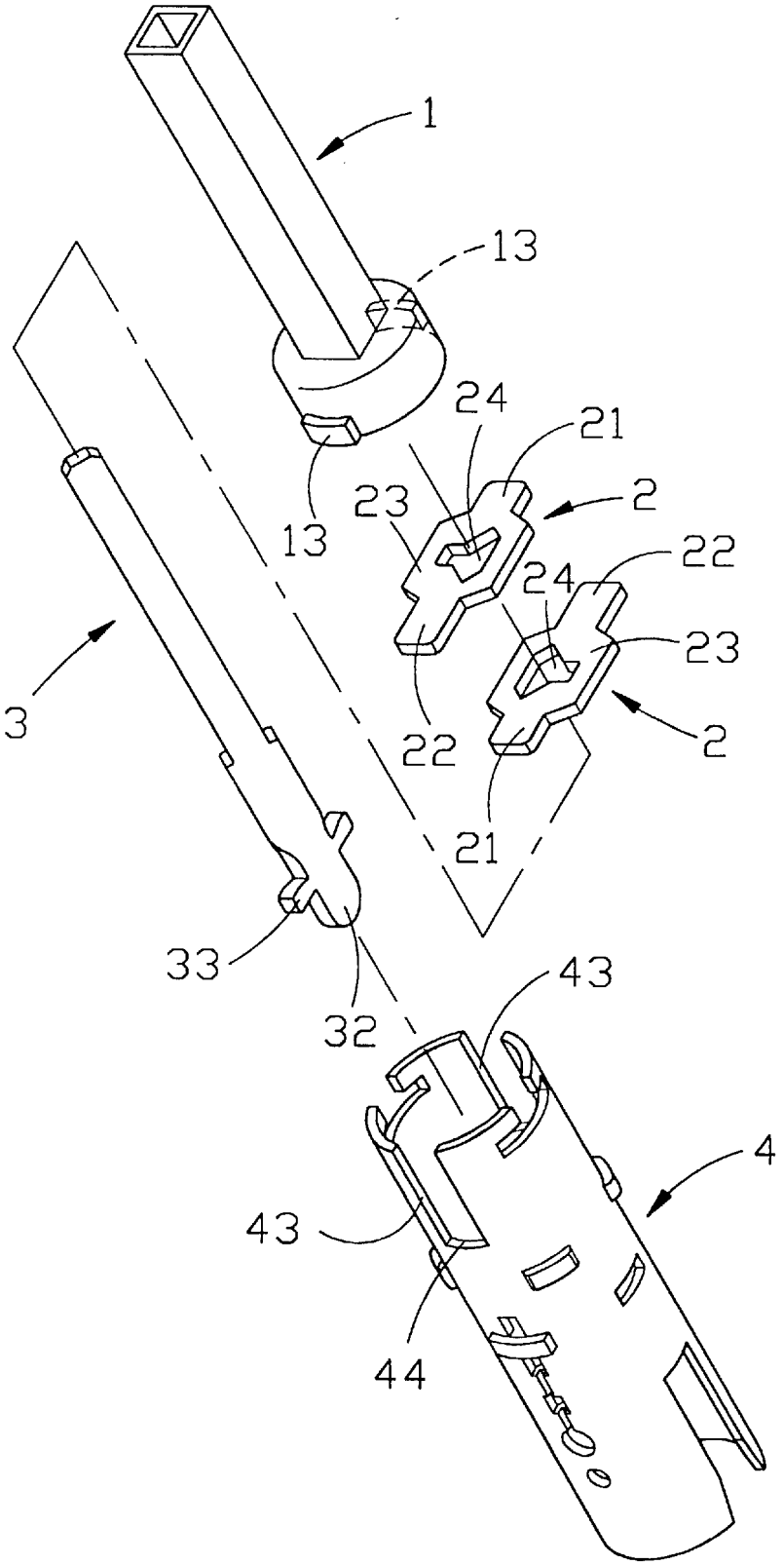
FIG. 5 illustrates a third embodiment of the present invention.

The outer spindle 4 constructed according to the present invention is also suitable for installing a plurality of slide plates 2, such as a pair of slide plates 2, to increase torsional strength. FIG. 4 shows a second embodiment wherein a pair slide plates 2 are superimposed on one another with their lugs 21 and 22 respectively aligned in the respective grooves 43. FIG. 5 shows a third embodiment wherein two slide plates 2 superimposed one another but with the lugs 21 and 22 thereof arranged alternatingly. As it was known in the art, such slide plate arrangement renders a lock set possible for either clockwise or counterclockwise operation.

Figure 6:
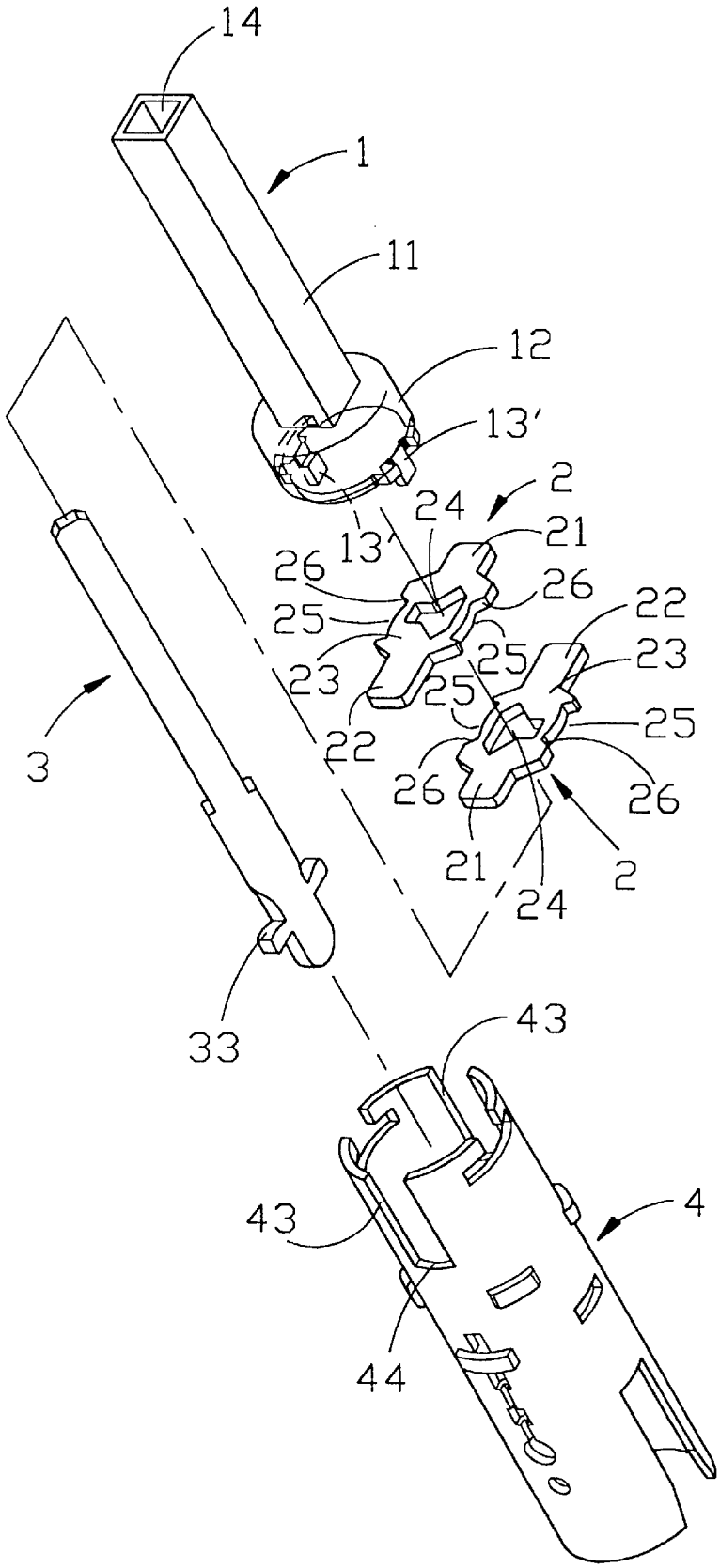
FIG. 6 is an exploded view of a fourth embodiment of the present invention.
Figure 7:
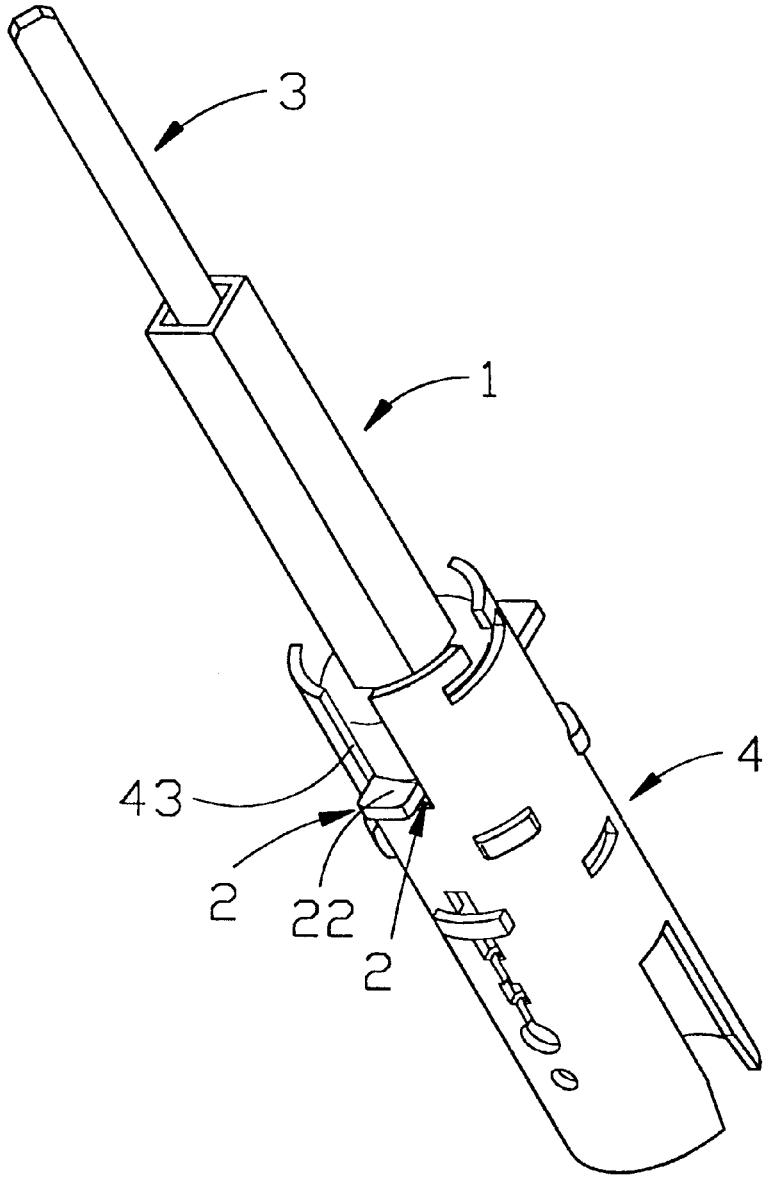
FIG. 7 is a perspective view of the fourth embodiment with the slide plates in a locking position.
Figure 8:
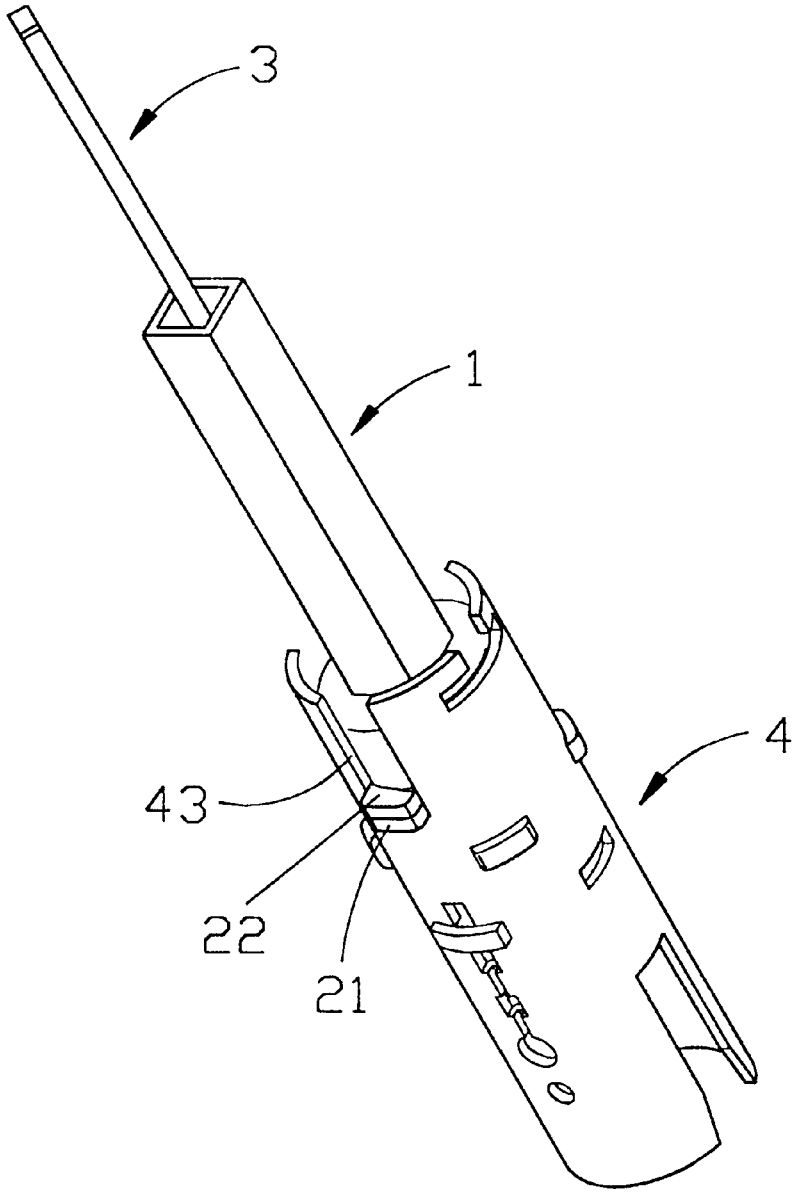
FIG. 8 is a perspective view of the fourth embodiment with the slide plates in an unlocking position.

The fourth embodiment shown in FIG. 6 is substantially similar to that of FIG. 5 except that the enlarged end 12 of the middle spindle 1 has axially extending protrusions 13' instead of the radially extending protrusions 13 shown in FIG. 5 and that each slide plate 2 is additionally provided with two notches 25 each having a bearing face 26 to be acted or pushed by one of the protrusions 13' of the middle spindle 1. As in the embodiment of FIG. 5, the slide plate 2 can be moved to a locking position (FIG. 7 wherein the lug is protruded) by turning the turning rod 3. However, unlike the radial protrusions 13, the axial protrusions 13' can actuate the slide plates 2 to move to the unlocking position (FIG. 8 in which the lug 22 is retracted) so that the outer spindle 4 can be unlocked and rotated by simply rotating the middle spindle 1 without the need to turn the turning rod 3. Such an arrangement was disclosed in the Applicant's U.S. Pat. No. 5,301,526.

Figure 9:
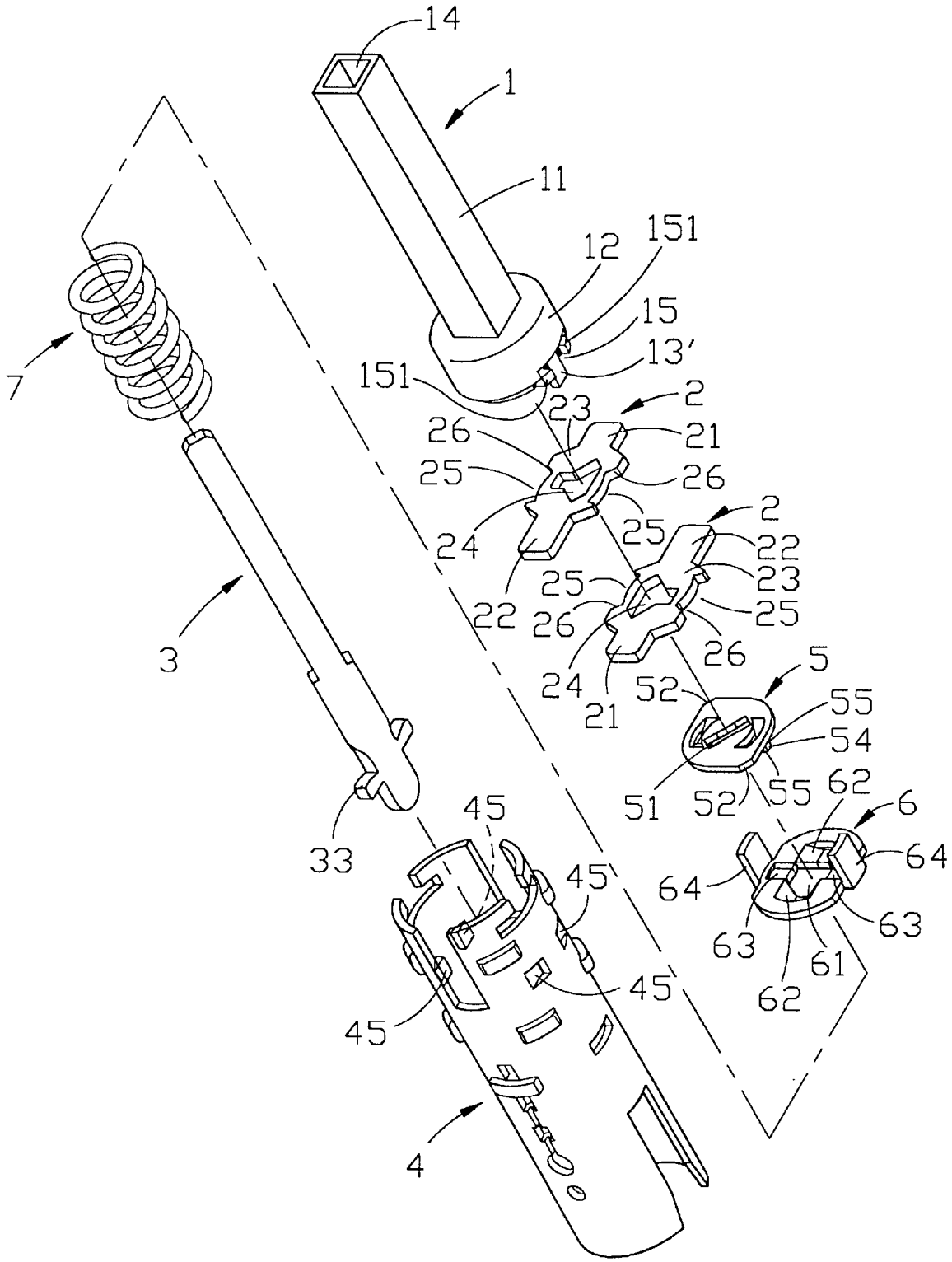
FIG. 9 illustrates a fifth embodiment of the present invention.

FIG. 9 shows a fifth embodiment which additionally comprises a clutch mechanism in the outer spindle 4 to connect and disconnect the outer spindle 4 and the middle spindle 1 as compared to the fourth embodiment of FIG. 6. The clutch mechanism comprises a rotary plate 5, an engaging plate 6 and a compression spring 7. The rotary plate 5 is placed between the slide plate 2 and the engaging plate 6, and the engaging plate 6 is urged by the compression spring 7. The rotary plate 5 has an elongated slot 51 for engagement with and for passage of the turning rod 3, two abutment faces 52 to abut the inner surface of the wall of the outer spindle 4, and two tenons 54 (only one is shown) projecting from one side thereof opposing the engaging plate 6, each tenon 54 having inclining cam faces 55, 55. The engaging plate 6 has a central hole 61 for inserting the turning rod 3, two wedge-shaped deep grooves 62, 62 on two sides of the hole 61, and two opposing shallow grooves 63, 63 spaced angularly from deep grooves 62, 62 substantially by 90 degs. Two opposing prongs 64, 64 extend axially from the engaging plate 6 and are aligned radially and respectively with the shallow grooves 63, 63. Each prong 64 is placed between one of two pairs of guide teeth 45 projecting from the inner surface of the wall of the outer spindle 4. The prongs 64 pass through the sides of the rotary plate 5 and the slide plate 2 and extend into the respective engaging recesses 15 of the middle spindle 1. As shown in FIG. 6 and 9, each engaging recess 15 is radially aligned with and provided outwardly of the respective protrusion 13'. Each engaging recess 15 is confined between two guide elements 151.

In assembly, the turning rod 3 passes through the spring 7, the engaging plate 6, the rotary plate 5, the two slide plates 2 and the middle spindle 1. When the turning rod 3 is turned to a position that causes the rotary plate 5 to rotate, the slide plates 2 to move radially inward of the spindle 4 and the tenons 54, 54 of the rotary plate 5 to fall into the respective deep grooves 62, 62 of the engaging plate 6. The prongs 64, 64 of the engaging plate 6 extend into the respective recesses 15 of the middle spindle 1 so that middle and outer spindles 1 and 4 are linked together. In this situation, the spindle 4 is unlocked.

When the turning rod 3 rotates the rotary plate 5 and pushes the slide plates 2 to move outwardly of the spindle 4, one of the inclining cam faces 55, 55 of the wedge-shaped tenons 54 of the rotary plate 5 pushes or cam the respective deep groove 62 of the engaging plate 6, thereby departing from the groove 62. The engaging plate 6 is therefore moved axially thereby disengaging the prongs 64, 64 from the recesses 15 of the middle spindle 1. When the turning rod reaches a predetermined angular position (after about 90 deg rotation), the tenons 54, 54 of the rotary plate 5 are received in the respective shallow grooves 63, 63 of the engaging plate 6, thereby placing the outer spindle 4 in a locked position. In this situation, the outer spindle 4 can not be rotated. When the outer spindle 4 is unlocked by operating the key operable lock of the outer knob, the outer spindle 4 permits the middle spindle 1 to rotate. In this situation, the middle spindle 1 can move inward the slide plates 2, 2 by means of its axial protrusions 13' and the turning rod 3 can be turned by the slide plate 2 to return to its unlocking position.

Figure 10:
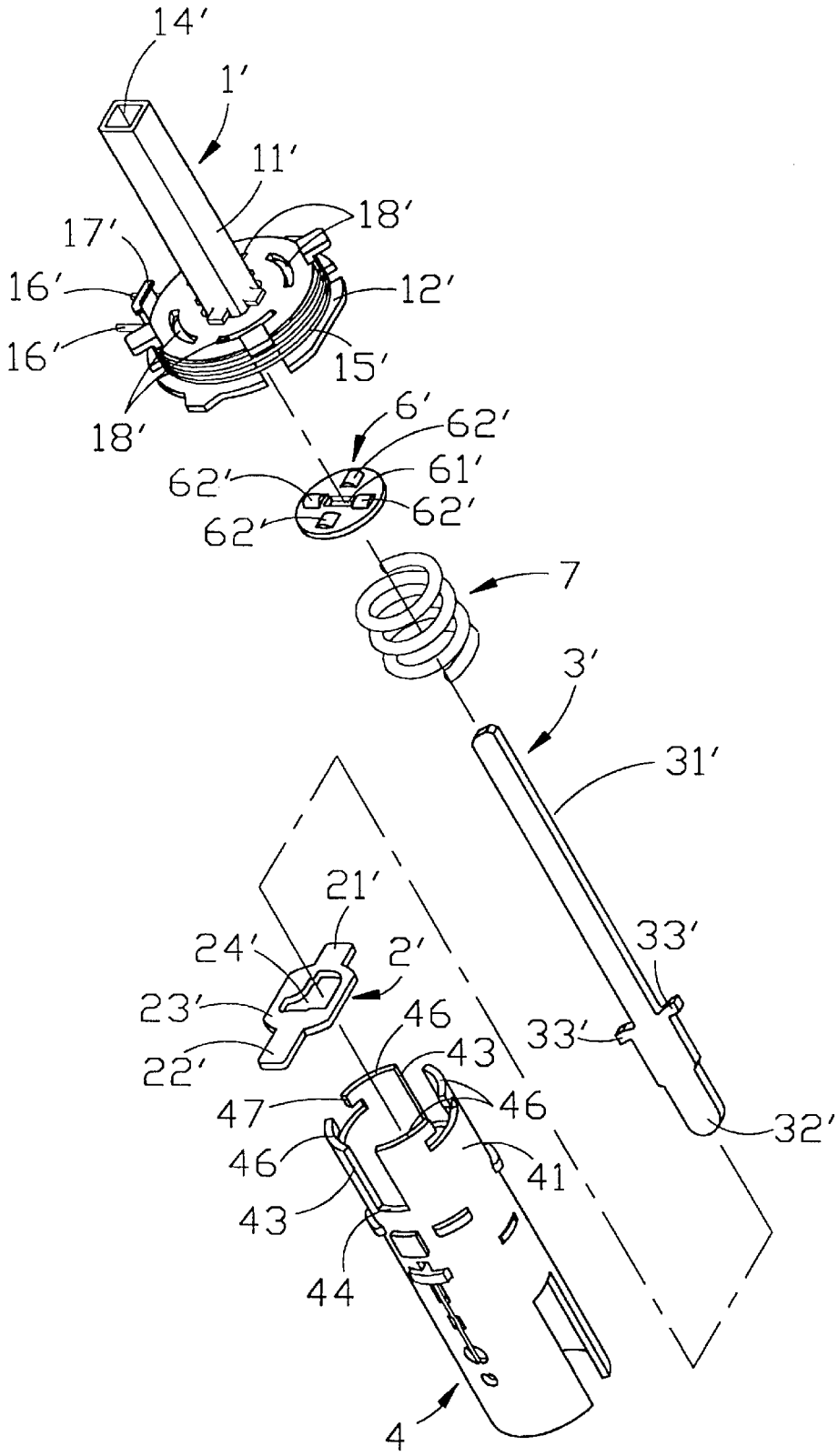
FIG. 10 shows a sixth embodiment of the present invention.

FIG. 10. shows a sixth embodiment of the invention which comprises, turning rod 3', slide plate 2', outer spindle 4, middle spindle 1', spring 7 and a positioning plate 6'. The turning rod 3' has two shoulder members 33' between two ends 31' and 32'. The slide plate 2' has two lugs 21' and 22', and a middle part 23' which has a hole 24' for passage of the turning rod 3'. Like the outer spindle 4 of the previous embodiments, the end 41 of the outer spindle 4 in this embodiment is provided with two grooves 43 and anchor members 46.

The middle spindle 1' includes a hollow body 11' having a through-bore 14' for passage of the turning rod 3', and an enlarged end portion 12'. The enlarged end portion 12' is provided with arc-shaped apertures 18' to engage the anchor members 46 of the outer spindle 4. A torsion spring 15' is sleeved around the enlarged end portion 12' and has two radially extending legs 16' which engages two sides of a projection 17' axially extending from the periphery of the enlarged end portion 12'. Like the torsion spring which is used conventionally for returning spindles and handles which have been turned for an unlocking operation, the torsion spring 15' can cooperate with stationary studs or fastening bolts (not shown) of a lock body, which are engageable with legs 16' of spring 15', so as to return the middle spindle 1' as well as the other spindles.

The positioning plate 6' has a substantially rectangular slot 61' for engagement with and for passage of the turning rod 3' and four bosses 62' which are engageable with indentations (not shown) provided in the inner surface of the enlarged end portion 12' for limiting undesirable rotation of the turning rod 3'.

In assembly, the lugs 21', 22' of slide plate 2' are positioned in grooves 43 of outer spindle 4. The end 32' of turning rod 3' passes through hole 24' of slide plate 2' and shoulder members 33' abut against slide plate 2'. Afterwards, spring 7, positioning plate 6' and the enlarged end portion 12' of middle spindle 1' are mounted on turning rod 3' through the end 31'. One end of the spring bears against shoulder members 33' of turning rod 3 and the other end thereof biases the positioning plate 6' against the enlarged end portion 12'. Anchor members 46 of outer spindle 4 are inserted into apertures 18', and hooks 47 thereof are then caused to engage the edges which define apertures 18' of middle spindle 1', via a limited relative rotation spindles 1' and 4.

Figure 11:
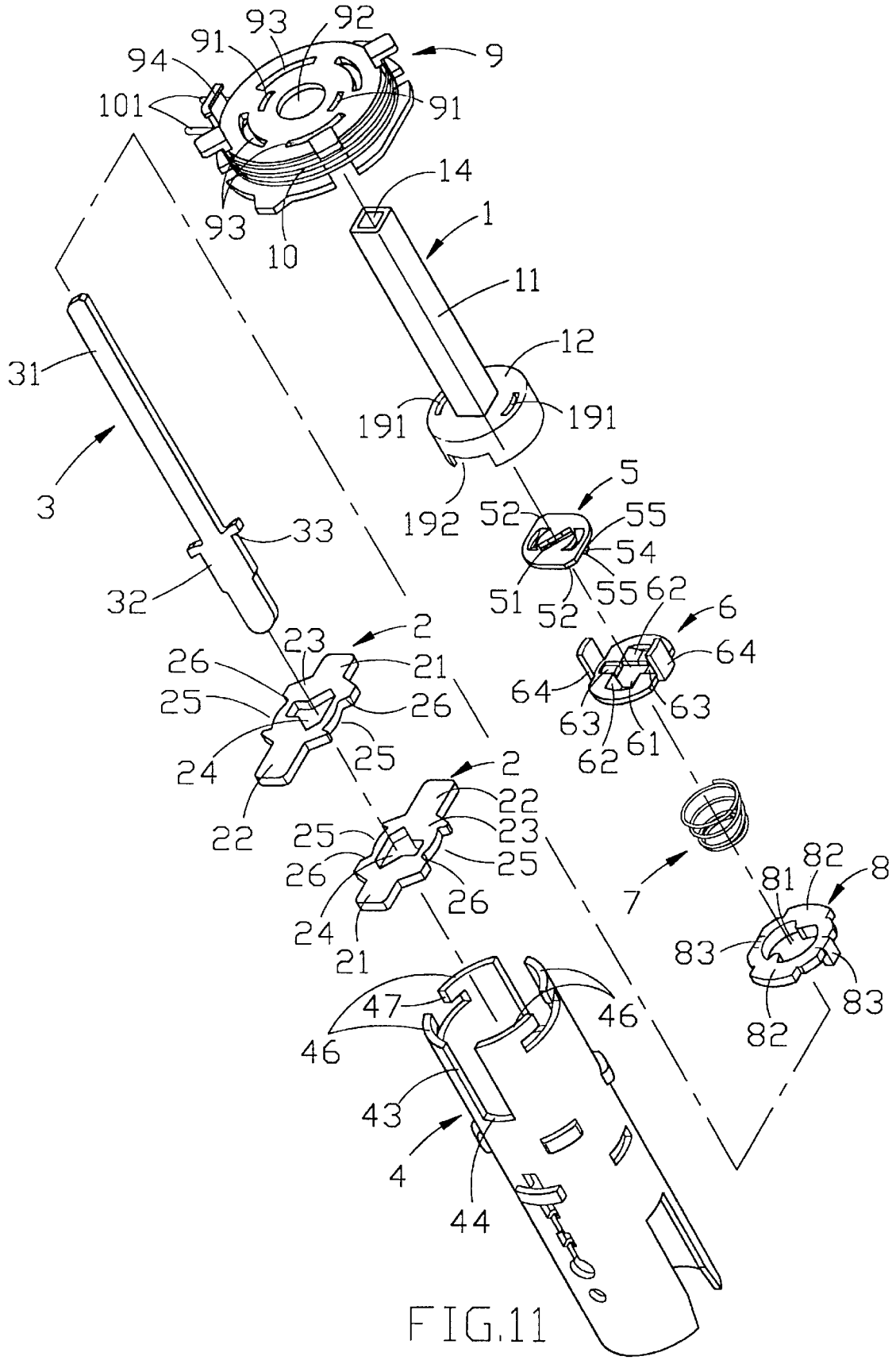
FIG. 11 shows a seventh embodiment of the present invention.

FIG. 11 shows the seventh embodiment of the invention wherein elements which are analogous to those contained in the previous embodiments are represented by like reference numerals. This embodiment comprises middle spindle 1, two slide plates 2, turning rod 3, outer spindle 4, rotary plate 5 and engaging plate 6 which have been mentioned hereinabove. In addition, the embodiment is further modified by using a rotary seat 9 and a connecting plate 8. The enlarged end portion 12 of middle spindle 1 is provided with curved apertures 191 and notches 192.

The rotary seat 9 has a construction substantially similar to the enlarged end portion 12' mentioned in the sixth embodiment and has a hole 92 so as to permit rotary seat 9 to be sleeved around middle spindle 1 outside of outer spindle 4. The rotary seat 9 further includes curved apertures 93 for engaging anchor members 46, slots 91 to be aligned with curved apertures 191 of middle spindle 1, and torsion spring 10 which has legs 101 and which is analogous to torsion spring 15' of FIG. 10.

The connecting plate 8 has a hole 81, two diametrically opposing and radially extending protrusions 82 for engagement with notches 16 of middle spindle 1, and two diametrically opposing and axially extending protrusions 83 for engagement with notches 25 of slide plates 2 as described in the fourth embodiment.

In assembly, lugs 21 and 22 of slide plates 2 are inserted in grooves 43, and turning rod 3 is caused to pass through holes 24 of slide plates 2 until shoulder members 33 contact slide plates 2. Rotary plate 5, engaging plate 6, spring 7 and connecting plate 8 are then sleeved around turning rod 3 between slide plates 2 and the enlarged end portion 12 of middle spindle 1. The enlarged end portion 12 receives rotary plate 5, engaging plate 6, spring 7 and connecting plate 8. Protrusion 82 of connecting plate 8 are placed in engagement with notches 192 of the enlarged end portion 12, and protrusions 83 extend respectively into notches 25 of slide plate 2 to act upon bearing face 26, thereby enabling middle spindle 1 to move slide plates 2 to locking or unlocking positions.

Shoulder members 33 of turning rod 3 are received in hole 81 of connecting plate 8 and in contact with one end of spring 7. The other end of spring 7 biases engaging plate 6 and rotary plate 5 against the enlarged end portion 12 so that prongs 64 constantly engage curved apertures 191 of middle spindle 1. The rotary seat 9 is sleeved around middle spindle 1 and coupled with outer spindle 4 through interengagement of anchor members 46 and curved apertures 93. The enlarged end portion 12 of middle spindle 1 is releaseably connected to rotary seat 9 by virtue of prongs 64 which pass through curved aperture 191 and extend into slots 91.

In operation, when slide plates 2 are moved to their locking position by rotating turning rod 3, rotary plate 5 moves axially engaging plate 6 in the direction away from rotary seat 9 in a manner as described with reference to FIG. 9 so that prongs 64 are moved out of slots 91 and the enlarged end portion 12 is disconnected from rotary seat 9 as well as outer spindle 4. When slide plates 2 are in their unlocking position, rotary plate 5 permits prongs 64 to re-engage slots 91 of rotary seat 9.

With the invention thus explained, it is apparent that various modifications and variations can be made without departing from the scope of the invention. It is therefore intended that the invention be limited only as indicated in the appended claims.

We claim:

1. A lock set for a door which comprises:

a rotatable outer spindle having a cylindrical wall;

at least one slide plate mounted movably in said cylindrical wall for moving between a locking position that locks said cylindrical wall against rotation and an unlocking position that permits said cylindrical wall to rotate, said slide plate having a hole therein;

a rotatable inner spindle;

a hollow middle spindle disposed between said inner and outer spindles, said middle spindle having one end provided with an enlarged end portion which extends into said cylindrical wall in a rotatable position relative to said cylindrical wall, and another end which is connected to said inner spindle;

a turning rod passing through said hollow middle spindle and having two ends extending to said outer and inner spindles, respectively, said turning rod passing through said hole of said slide plate for moving said slide plate to said locking or unlocking position;

a rotary seat provided adjacent to said one end of said outer spindle and connected to said cylindrical wall for simultaneous rotation, said rotary seat further having a hole for passage of said middle spindle in a rotatable position relative to said rotary seat, and a torsion spring sleeved around said rotary seat for returning said rotary seat and said outer spindle to their normal position after a turning movement;

a clutch mechanism provided in said cylindrical wall for connecting or disconnecting said enlarged end portion to or from said rotary seat, thereby permitting said middle spindle to turn via said inner spindle and said outer spindle when said slide plate is in said unlocking position, or via said inner spindle only when said slide plate is in said locking position, said enlarged end portion being located between said slide plate and said rotary seat, said clutch mechanism including an engaging plate which is sleeved around said turning rod movably between said enlarged end portion and said slide plate for moving axially away from or toward said enlarged end portion, said clutch mechanism further having means associated with said turning rod for camming said engaging plate to move axially away from said enlarged end portion upon turning of said turning rod, a spring provided between said engaging plate and said slide plate so as to urge said engaging plate toward said enlarged end portion, and a rotary plate sleeved fittingly on said turning rod for simultaneous rotation, said rotary plate being provided between said enlarged end portion and said engaging plate, said means for camming said engaging plate being provided on said rotary plate, said engaging plate further having a prong which extends axially toward said enlarged end portion and said rotary seat, said enlarged end portion further having an aperture, said rotary seat further having a slot in alignment with said aperture of said enlarged end portion in an axial direction, said prong extending through said slot of said rotary seat and said aperture of said enlarged end portion when said engaging plate is moved toward said enlarged portion; and a connecting plate which has means for engaging with said slide plate and said enlarged end portion so as to move said slide plate via the rotation of said enlarged end portion, said connecting plate being sleeved on said turning rod in said cylindrical wall.

2. The lock set as claimed in claim 1, wherein said means for camming said engaging plate includes a pair of wedge-shaped tenons which project axially from said rotary plate to said engaging plate and each of which has a cam face, said engaging plate having two diametrically opposite shallow grooves and two diametrically opposite wedge-shaped deep grooves to interact with said cam faces of said tenons, said deep and shallow grooves being spaced angularly with a spacing of substantially 90 degrees.

3. The lock set as claimed in claim 2, wherein said rotary plate further has an elongated hole for passage of and for engagement with said turning rod.

4. The lock set as claimed in claim 1, wherein said connecting plate is disposed between said engaging plate and said slide plate, said spring urging said engaging plate and said rotary plate toward said enlarged end portion, said connecting plate having two diametrically opposing and radially extending protrusions for engaging with said enlarged end portion, and two diametrically opposing and axially extending protrusions for engaging with said slide plate.

5. A lock set for a door which comprises:

a rotatable outer spindle having a cylindrical wall;

at least one slide plate mounted movably in said cylindrical wall for moving between a locking position that locks said cylindrical wall against rotation and an unlocking position that permits said cylindrical wall to rotate, said slide plate having a hole therein;

a rotatable inner spindle;

a hollow middle spindle disposed between said inner and outer spindles, said middle spindle having one end provided with an enlarged end portion which extends into said cylindrical wall in a rotatable position relative to said cylindrical wall, and another end which is connected to said inner spindle;

a turning rod passing through said hollow middle spindle and having two ends extending to said outer and inner spindles, respectively, said turning rod also passing through said hole of said slide plate for moving said slide plate to said locking or unlocking position;

a rotary seat provided adjacent to said one end of said outer spindle and connected to said cylindrical wall for simultaneous rotation, said rotary seat further having a hole for passage of said middle spindle in a rotatable position relative to said rotary seat, and a torsion spring sleeved around said rotary seat for returning said rotary seat and said outer spindle to their normal position after a turning movement;

a clutch mechanism provided in said cylindrical wall for connecting or disconnecting said enlarged end portion to or from said rotary seat, thereby permitting said middle spindle to turn via said inner spindle and said outer spindle when said slide plate is in said unlocking position, or via said inner spindle only when said slide plate is in said locking position; and a connecting plate which has means for engaging with said slide plate and said enlarged end portion so as to move said slide plate via the rotation of said enlarged end.

* * * * *